US009101021B2

(12) United States Patent
Lys

(10) Patent No.: US 9,101,021 B2
(45) Date of Patent: Aug. 4, 2015

(54) SOLID-STATE LIGHTING APPARATUS AND METHODS USING PARALLEL-CONNECTED SEGMENT BYPASS CIRCUITS

(75) Inventor: Ihor Lys, La Jolla, CA (US)

(73) Assignee: Cree, Inc., Durham, NC (US)

( * ) Notice: Subject to any disclaimer, the term of this patent is extended or adjusted under 35 U.S.C. 154(b) by 342 days.

(21) Appl. No.: 13/339,974

(22) Filed: Dec. 29, 2011

(65) Prior Publication Data

US 2013/0169159 A1 Jul. 4, 2013

(51) Int. Cl.
*H05B 37/02* (2006.01)
*H05B 33/08* (2006.01)

(52) U.S. Cl.
CPC ..... *H05B 33/083* (2013.01)

(58) Field of Classification Search
USPC ..... 315/291, 224, 307, 294, 119, 125, 126, 315/209 R, 185 R, 312
See application file for complete search history.

(56) References Cited

U.S. PATENT DOCUMENTS

| | | | | |
|---|---|---|---|---|
| 5,803,579 | A | 9/1998 | Turnbull et al. | |
| 5,941,626 | A | 8/1999 | Yamuro | |
| 7,088,059 | B2 | 8/2006 | McKinney et al. | |
| 7,994,725 | B2 | 8/2011 | Bouchard | |
| 2002/0097095 | A1 | 7/2002 | Jeon et al. | |
| 2003/0156609 | A1 | 8/2003 | Tsai | |
| 2004/0046510 | A1 | 3/2004 | Allen | |
| 2007/0108843 | A1 | 5/2007 | Preston et al. | |
| 2010/0060175 | A1 | 3/2010 | Lethellier | |
| 2010/0134018 | A1 | 6/2010 | Tziony et al. | |
| 2010/0171442 | A1 | 7/2010 | Draper et al. | |
| 2010/0181923 | A1* | 7/2010 | Hoogzaad | 315/185 R |
| 2010/0231133 | A1 | 9/2010 | Lys | |
| 2010/0308738 | A1 | 12/2010 | Shteynberg et al. | |
| 2010/0308739 | A1* | 12/2010 | Shteynberg et al. | 315/193 |
| 2011/0006689 | A1* | 1/2011 | Blanchard et al. | 315/121 |
| 2011/0068701 | A1* | 3/2011 | van de Ven et al. | 315/185 R |
| 2011/0068702 | A1* | 3/2011 | van de Ven et al. | 315/186 |
| 2011/0127919 | A1 | 6/2011 | Lin | |
| 2011/0199003 | A1* | 8/2011 | Muguruma et al. | 315/122 |
| 2011/0266961 | A1 | 11/2011 | Tsai | |
| 2011/0273098 | A1 | 11/2011 | Grajcar | |
| 2011/0273102 | A1 | 11/2011 | van de Ven et al. | |
| 2011/0309757 | A1* | 12/2011 | Weaver et al. | 315/188 |
| 2012/0091920 | A1 | 4/2012 | Yang | |
| 2012/0099321 | A1 | 4/2012 | Scott et al. | |

OTHER PUBLICATIONS

International Search Report Corresponding to International Application No. PCT/US2012/071366; Date of Mailing: Mar. 8, 2013; 12 Pages.

Athalye, Praneet Jayant, "Solid-State Lighting Apparatus and Methods Using Energy Storage", U.S. Appl. No. 13/235,103, filed Sep. 16, 2011; 23 pages.

Ni, Liqin, "Solid-State Lighting Apparatus and Methods Using Current Diversion Controlled by Lighting Device Bias States", U.S. Appl. No. 13/235,127, filed Sep. 16, 2011; 23 pages.

* cited by examiner

*Primary Examiner* — Minh Dieu A
(74) *Attorney, Agent, or Firm* — Myers Bigel Sibley & Sajovec, P.A.

(57) ABSTRACT

A lighting apparatus includes a plurality of light emitting diode (LED) sets coupled in series. The apparatus further includes a bypass circuit coupled in parallel with one of the LED sets and configured to sense and control a bypass current when the one of the LED sets is in a first bias state and to attenuate the bypass current responsive to a transition of the one of the LED sets to a second bias state. The first bias state may be substantially non-conducting and the second bias state may be conducting. The apparatus may include a plurality of such bypass circuits, respective ones of which are coupled in parallel with respective ones of the LED sets such that the bypass circuits are coupled in series.

35 Claims, 10 Drawing Sheets

SOLID-STATE LIGHTING APPARATUS AND METHODS USING PARALLEL-CONNECTED SEGMENT BYPASS CIRCUITS

FIELD

The present inventive subject matter relates to lighting apparatus and methods and, more particularly, to solid-state lighting apparatus and methods.

BACKGROUND

Solid-state lighting arrays are used for a number of lighting applications. Solid-state light emitting devices used in such an array may include, for example, packaged light emitting devices including one or more light emitting diodes (LEDs). Such LEDs may include inorganic LEDs, which may include semiconductor layers forming p-n junctions and/or organic LEDs (OLEDs), which may include organic light emission layers.

Solid-state lighting panels including arrays of solid-state light emitting devices have been used as direct illumination sources, for example, in architectural and/or accent lighting. Solid-state lighting devices are also used in lighting fixtures, such as incandescent bulb replacement applications, task lighting, recessed light fixtures and the like. For example, Cree, Inc. produces a variety of recessed downlights, such as the LR-6 and CR-6, which use LEDs for illumination. Solid-state lighting panels are also commonly used as backlights for small liquid crystal display (LCD) screens, such as LCD display screens used in portable electronic devices, and for larger displays, such as LCD television displays.

Some attempts at providing solid-state lighting sources have involved driving an LED or string or group of LEDs using a rectified AC waveform. However, because the LEDs require a minimum forward voltage to turn on, the LEDs may turn on for only a part of the rectified AC waveform, which may result in visible flickering, may undesirably lower the power factor of the system, and/or may increase resistive loss in the system. Examples of techniques for driving LEDs with a rectified AC waveform are described in U.S. Patent Application Publication No. 2010/0308738, U.S. Patent Application Publication No. 2010/0231133, and in copending U.S. patent application Ser. No. 12/777,842, filed May 7, 2010), the last of which is commonly assigned to the assignee of the present application. Other control techniques for AC-powered solid state lighting apparatus are described in U.S. patent Ser. No. 13/235,103 entitled "Solid State Lighting Apparatus and Methods Using Energy Storage", filed Sep. 16, 2011, and U.S. patent Ser. No. 13/235,127 entitled "Solid State Lighting Apparatus and Methods Using Current Diversion Controlled by Lighting Device Bias States", filed Sep. 16, 2011.

SUMMARY

In some embodiments of the inventive subject matter, a lighting apparatus includes a plurality of light emitting diode (LED) sets coupled in series. The apparatus further includes a bypass circuit coupled in parallel with one of the LED sets and configured to sense and control a bypass current when the one of the LED sets is in a first bias state and to attenuate the bypass current responsive to a transition of the one of the LED sets to a second bias state. The first bias state may be less conducting than the second bias state, e.g., the first bias state may be a bias insufficient to cause the one of the LED sets to conducting current sufficient to provide illumination and the second bias state may be a bias that causes current flow through the one of the LED sets sufficient to provide illumination. The bypass circuit may be configured to maintain a substantially constant bypass current when the at least one of the LED sets is in the first bias state.

The bypass circuit may include a plurality of bypass circuits, respective ones of which are coupled in parallel with respective ones of the LED sets. The LED sets may be disjoint, and the bypass circuits may be coupled in series.

In some embodiments, the bypass circuit including a current sensor configured to sense the bypass current and a current control circuit coupled to the current sensor and configured to control the bypass current responsive to the current sensor. The at least one of the LED sets may include a string of LEDs coupled in series and the current sensor may be coupled to an internal node of the string and configured to conduct a current to or from the internal node.

In some embodiments, the current control circuit may include a transistor having a first terminal coupled to a first terminal node of the string and the current sensor may include a resistor having a first terminal coupled to a second terminal node of the string and a second terminal coupled to a second terminal of the transistor and to an internal node of the string. The second terminal of the resistor may be coupled to the internal node of the string.

The current control circuit may further include a gain circuit configured to control the transistor responsive to a voltage at the first terminal of the resistor. The transistor may include a bipolar junction transistor or a field-effect transistor.

In some embodiments, the lighting apparatus may further include a current control circuit coupled in series with the plurality of LED sets. The lighting apparatus may also include a rectifier circuit having an input configured to be coupled to an AC power source and an output coupled to the current control circuit and the plurality of LED sets.

In further embodiments of the inventive subject matter, a controller for a lighting apparatus includes a plurality of bypass circuits configured to be coupled in parallel with respective ones of a plurality of LED sets that are coupled in series. Each bypass circuit is configured to sense and control a bypass current when the LED set coupled in parallel therewith is in a first bias state and to attenuate the bypass current responsive to a transition of the LED set coupled in parallel therewith to a second bias state. The first bias state may be less conducting than the second bias state. The LED sets may be disjoint, and the bypass circuits may be coupled in series.

In some embodiments, each bypass circuit may include a current sensor configured to sense the bypass current and a current control circuit coupled to the current sensor and configured to control the bypass current responsive to the current sensor. The LED set coupled in parallel therewith may include a string of LEDs coupled in series and the current sensor may be coupled to an internal node of the string and configured to conduct a current to or from the internal node. The current control circuit may include a transistor having a first terminal coupled to a first terminal node of the string and the current sensor may include a resistor having a first terminal coupled to a second terminal node of the string and a second terminal coupled to a second terminal of the transistor and to the internal node of the string. The current control circuit may further include a gain circuit configured to control the transistor responsive to a voltage at the second terminal of the resistor.

According to additional embodiments, a lighting apparatus includes a plurality of strings of LEDs coupled in series and respective bypass circuits coupled in parallel with respective ones of the strings. Each bypass circuit includes a transistor having a first terminal coupled to first terminal node of one of the strings and a resistor having a first terminal coupled to a second terminal node of the one of the strings and a second terminal coupled to a second terminal of the transistor and to an internal node of the one of the strings. Each bypass circuit may further include a gain circuit configured to control the transistor responsive to a voltage at the second terminal of the resistor.

Further embodiments of the inventive subject matter provide a lighting apparatus including a plurality of strings of LEDs coupled in series and a bypass circuit coupled to first and second terminal nodes of one of the strings and configured to control a bypass current between the first and second terminal nodes responsive to a current to or from an internal node of the one of the strings. The bypass circuit may include a current sense input coupled to the internal node of the one of the strings. For example, the bypass circuit may include a current sense resistor configured to conduct the bypass current and coupled to the internal node of the one of the strings.

The bypass circuit may include a transistor coupled between the current sense resistor and one of the first and second terminal nodes of the one of the strings. The bypass circuit may further include a gain circuit coupled to the current sense resistor and configured to control the transistor. The bypass circuit may include a plurality of bypass circuits, respective one of which are coupled in parallel with respective ones of the strings.

BRIEF DESCRIPTION OF THE DRAWINGS

The accompanying drawings, which are included to provide a further understanding of the inventive subject matter and are incorporated in and constitute a part of this application, illustrate certain embodiment(s) of the inventive subject matter. In the drawings.

DETAILED DESCRIPTION

Figure 1:
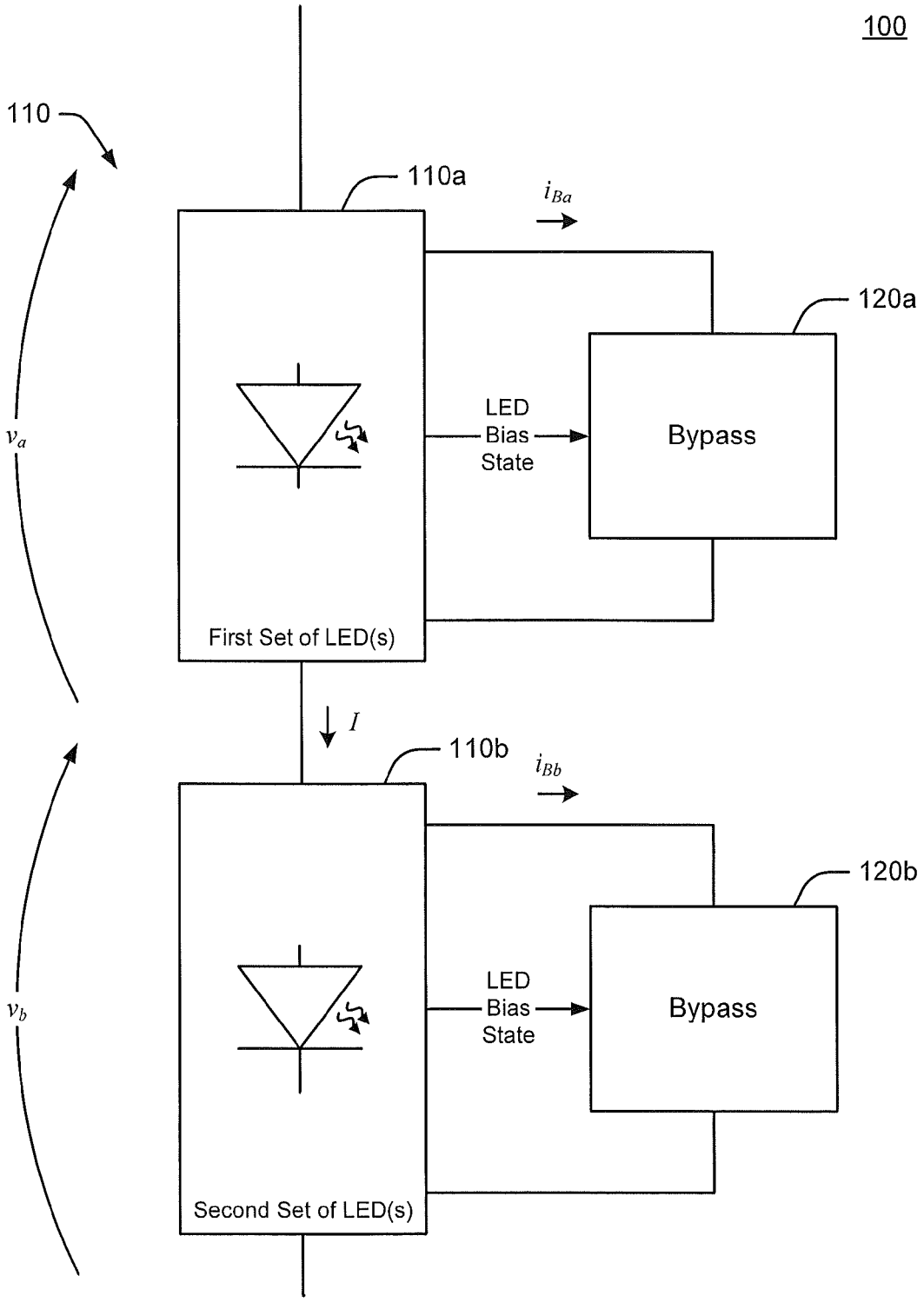
FIG. 1 illustrates a lighting apparatus according to some embodiments.

Embodiments of the present inventive subject matter now will be described more fully hereinafter with reference to the accompanying drawings, in which embodiments of the inventive subject matter are shown. This inventive subject matter may, however, be embodied in many different forms and should not be construed as limited to the embodiments set forth herein. Rather, these embodiments are provided so that this disclosure will be thorough and complete, and will fully convey the scope of the inventive subject matter to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present inventive subject matter. As used herein, the term "and/or" includes any and all combinations of one or more of the associated listed items.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

It will be understood that when an element or layer is referred to as being "on" another element or layer, the element or layer can be directly on another element or layer or intervening elements or layers may also be present. In contrast, when an element is referred to as being "directly on" another element or layer, there are no intervening elements or layers present. As used herein, the term "and/or" includes any and all combinations of one or more of the associated listed items.

The terminology used herein is for the purpose of describing particular embodiments only and is not intended to be limiting of the present inventive subject matter. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this present inventive subject matter belongs. It will be further understood that terms used herein should be interpreted as having a meaning that is consistent with their meaning in the context of this specification and the relevant art and will not be interpreted in an idealized or overly formal sense unless expressly so defined herein. The term "plurality" is used herein to refer to two or more of the referenced item.

The expression "lighting apparatus", as used herein, is not limited, except that it indicates that the device is capable of emitting light. That is, a lighting apparatus can be a device which illuminates an area or volume, e.g., a structure, a swimming pool or spa, a room, a warehouse, an indicator, a road, a parking lot, a vehicle, signage, e.g., road signs, a billboard, a ship, a toy, a mirror, a vessel, an electronic device, a boat, an aircraft, a stadium, a computer, a remote audio device, a remote video device, a cell phone, a tree, a window, an LCD display, a cave, a tunnel, a yard, a lamppost, or a device or array of devices that illuminate an enclosure, or a device that is used for edge or back-lighting (e.g., back light poster, signage, LCD displays), bulb replacements (e.g., for replacing AC incandescent lights, low voltage lights, fluorescent lights, etc.), lights used for outdoor lighting, lights used for security lighting, lights used for exterior residential lighting (wall mounts, post/column mounts), ceiling fixtures/wall sconces, under cabinet lighting, lamps (floor and/or table and/or desk), landscape lighting, track lighting, task lighting, specialty lighting, ceiling fan lighting, archival/art display lighting, high vibration/impact lighting, work lights, etc., mirrors/vanity lighting, or any other light emitting device.

The present inventive subject matter further relates to an illuminated enclosure (the volume of which can be illuminated uniformly or non-uniformly), comprising an enclosed space and at least one lighting apparatus according to the present inventive subject matter, wherein the lighting apparatus illuminates at least a portion of the enclosed space (uniformly or non-uniformly). In some embodiments described herein, bypass circuits that are used for controlling operation sets of LEDs in a string are controlled responsive to bias states of the LEDs in the sets. In particular, in some embodiments, a current controller in a bypass circuit for a set of LEDs may sense a current within the LEDs set resulting from a forward biasing of a subset of the LEDs of the set becoming sufficient to turn on the LEDs.

According to further aspects, a bypass circuit may include a current sensor (e.g., a resistor) and a gain circuit that receives a bypass current sense signal, e.g., a voltage across the current sense resistor, and responsively drives a variable resistance, such as a transistor, to control the bypass current through the bypass circuit. In embodiments described below, the gain circuit may include, for example, a feedback network used to drive a base of a bipolar transistor used to control bypass current, or may be inherent in a depletion-mode field-effect transistor used in a similar manner. It will be appreciated that any of a wide variety of gain circuits may be utilized in other embodiments, and that, in general, bypass circuits or components thereof may be realized using discrete circuit components and/or using circuit elements integrated on a common microelectronic substrate, e.g., in an integrated circuit or module. Such circuitry may be also be integrated with LEDs and other circuitry on a common microelectronic substrate, module, or the like.

It will be appreciated that, in general, semiconductor diodes do not begin conducting electricity until a certain threshold voltage in a "forward" direction ("forward biased") is present. The voltage drop across a forward-biased diode once it is in a conducting state generally varies only a little with the current. Embodiments described herein referred to bias transitions for LEDs in which an LED or a string of LEDs transitions between a conducting state and a substantially non-conducting state and vice versa. It will be appreciated that a diode may be insufficiently forward biased such that it is in a substantially non-conducting state in which it conducts a relatively small or insignificant amount of current. As used herein, a "non-conducting" bias state includes such insufficiently forward-biased states, including states wherein the LED or LEDs is/are insufficiently forward biased to conduct current sufficient to cause significant illumination. Such non-conducting states may also include "reverse bias" states.

FIG. 1 illustrates a lighting apparatus 100 according to some embodiments of the inventive subject matter. The apparatus 100 includes a plurality of sets 110 of LEDs, including a first set 110*a* and a second set 110*b* coupled in series. It will be understood that the apparatus 100 may include additional sets of LEDs, as well as other circuitry coupled in series and/or in parallel with the sets 110 of LEDs, such a rectifier circuit, a string current control circuit, etc. It will be further understood that the sets 110 may generally include one or more LEDs coupled in series, LEDs coupled in parallel and/or serial combinations of LEDs coupled in parallel.

Respective first and second bypass circuits 120*a*, 120*b* are coupled in parallel with respective ones of the first and second LED sets 110*a*, 110*b*. The bypass circuits 120*a*, 120*b* are configured to conduct respective bypass currents $i_{Ba}$, $i_{Bb}$ when the respective LED 43*a* sets 110*a*, 110*b* coupled thereto are biased such that they substantially block current flow (i.e., are substantially non-conducting). In some embodiments, the bypass circuits 120*a*, 120*b* may be configured to maintain a substantially constant current therethrough when the respective LED sets 110*a*, 110*b* coupled thereto are biased such that they are substantially non-conducting. Responsive to a sufficient forward biasing of at least some LEDs in the respective LED sets 110*a*, 110*b* coupled thereto as voltages $v_a$, $v_b$ across the LED sets 110*a*, 110*b* increase, the bypass circuits 120*a*, 120*b* attenuate or block their respective bypass currents $i_{Ba}$, $i_{Bb}$, such that current preferentially flows through the now conducting LED sets 110*a*, 110*b*. As explained in greater detail below, serially-connected sets of LEDs, such as the sets 110*a*, 110*b* of FIG. 1, may be incrementally activated in response to a full-wave rectified voltage to provide reduced flicker, improved power factor and other benefits when the LEDs are driven from a rectified AC power source.

The arrangement illustrated in FIG. 1 can provide several potential advantages. For example, in contrast to bypass circuit arrangements in which various nodes of a string of LEDs are each shunt to a common ground terminal, the bypass circuits 120*a*, 120*b* are coupled in parallel with respective LED sets 110*a*, 110*b* that are disjoint, i.e., do not have common members. Therefore, the bypass circuits 120*a*, 120*b* are coupled in series with one another and, thus, are not required to handle relatively large voltages that may develop across all or plural ones of the sets 110 of LEDs. Thus, for example, in embodiments using bypass transistors along the lines described below, the bypass transistors may not require large voltage ratings, which may reduce size and cost and may improve reliability. The individual bypass circuits 120*a*, 120*b* may operate independently such that, for example, failure of a single bypass circuit may not prevent continued operation of the lighting apparatus, instead allowing operation in a degraded, but potentially acceptable, mode.

Figure 2:
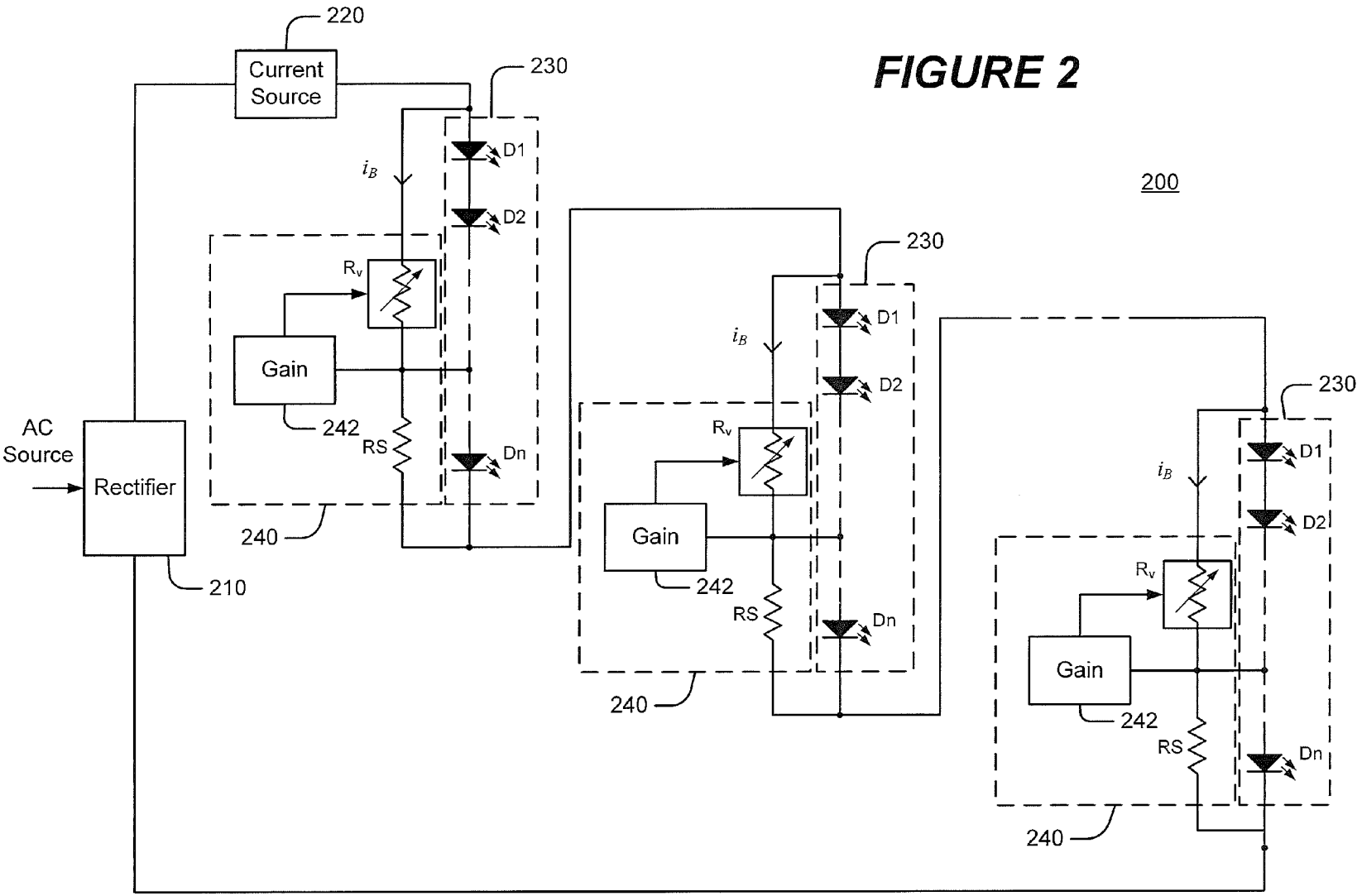
FIG. 2 illustrates a lighting apparatus according to further embodiments.

FIG. 2 illustrates a lighting apparatus 200 according to some embodiments that supports such operations. The lighting apparatus 200 includes a rectifier circuit 210, which is configured to be coupled to an AC power source and to produce a full-wave rectified AC output therefrom. A current source circuit 220 is coupled to the rectifier circuit 210, in series with a plurality of strings 230 of LEDs. The strings 230 each include a plurality of serially connected LEDs D1, D2, . . . , Dn. Although the strings 230 illustrated in FIG. 2 are shown as including the same number of LEDs, it will be appreciated that the strings may include different numbers of serially connected LEDs. The serially connected LEDs may include individual LEDS and/or parallel arrangements of multiple LEDs.

The lighting apparatus 200 further includes a plurality of bypass circuits 240 coupled across respective ones of the strings 230. As illustrated, each bypass circuit 240 includes a current sense resistor RS configured to carry a bypass current $i_B$, coupled in series with a variable resistance $R_v$, such as may be provided by a transistor or similar device. Responsive to a voltage at a terminal of the current sense resistor, a gain circuit 242 controls the variable resistance $R_v$. An internal node of the associated string 230 is coupled to the current feedback input of the gain circuit 242, and the gain circuit 242 is configured to attenuate or block the bypass current $i_B$ responsive thereto. The strings 230 and the bypass circuits 240 are configured such that, for example, as the full-wave rectified voltage produced by the rectifier increases, the strings 230 are sequentially turned on. During this turn on sequence, non-conducting ones of the strings 230 are bypassed by their respective bypass circuits 240, which maintain the bypass circuit $i_B$ at a substantially constant level. Similarly, as the rectified voltage decreases, the strings 230 are turned off in reverse order.

Figure 3:
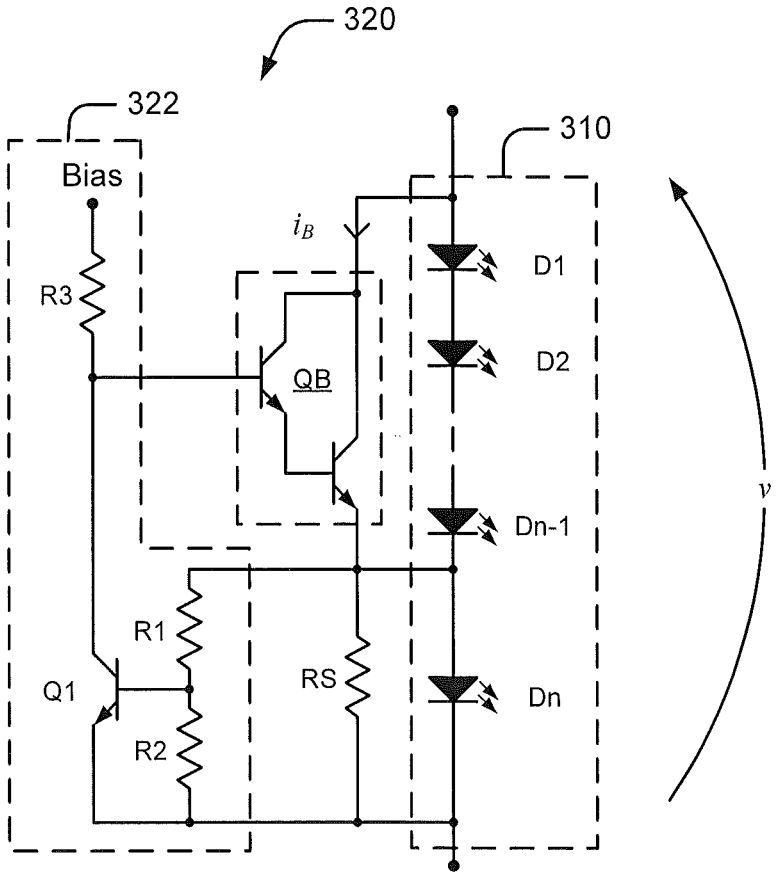
FIG. 3 illustrates a bypass circuit for the apparatus of FIG. 2 according to some embodiments.
Figure 4:
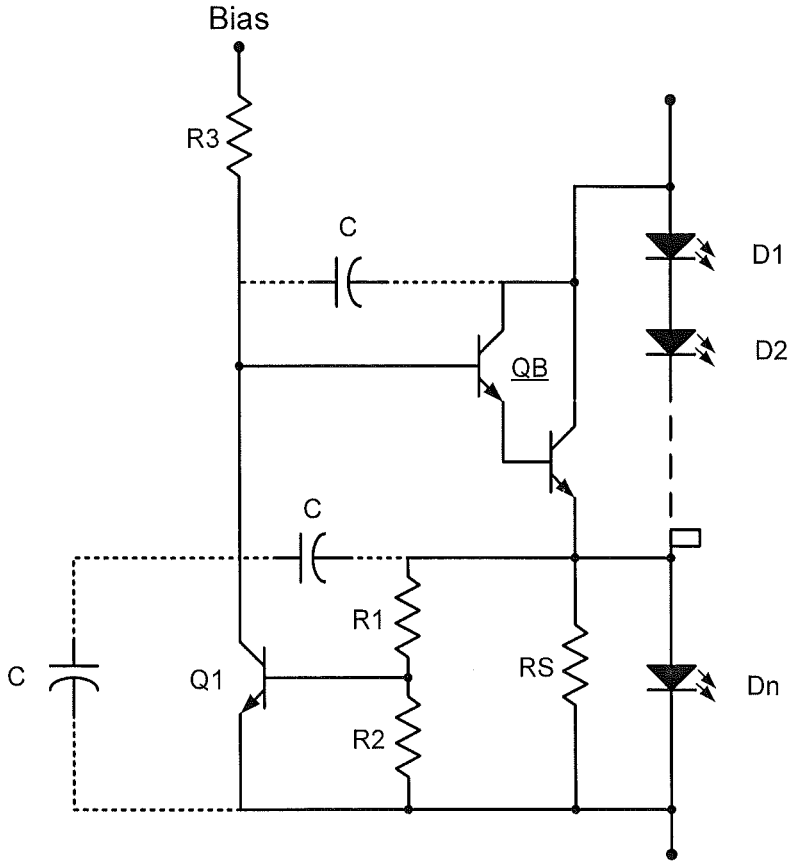
FIG. 4 illustrates various compensation capacitor arrangements for the bypass circuit of FIG. 3 according to some embodiments.

FIG. 3 illustrates an exemplary implementation of a bypass circuit 320 that may be used in the arrangement of FIG. 2 according to some embodiments. The bypass circuit 320 includes a current sense resistor RS coupled in series with a Darlington NPN transistor QB across a string 310 of LEDs D1, D2, . . . , Dn. The bypass circuit 320 further includes a gain circuit 322, which controls the transistor QB. The gain circuit 322 includes resistors R1, R2, R3 and an NPN transistor Q1. The bias for the resistor R3 may be provided by a preceding stage. FIG. 4 illustrates potential locations for capacitors C, any or all of which may be used to increase stability of the bypass circuit 320.

The bypass circuit 320 may operate as follows. As a voltage v across the string 310 increases, a bypass current $i_B$ initially passes through the bypass circuit 320. Through action of the gain circuit 322, the bypass current $i_B$ is maintained at a substantially constant level as the voltage v increases. At a certain level, the increase in the voltage v causes LEDs D1, D2, . . . , Dn−1 to become sufficiently forward biased such that current flows therethrough and the LEDs D1, D2, . . . , Dn−1 begin to emit light. Current flow from the node in the string 310 at which the current sense resistor RS is connected causes the voltage at base of the transistor Q1 to rise and cause the transistor QB to transition to a cutoff (high impedance) state. Eventually, the final LED Dn becomes sufficiently forward biased such that, above a certain level of the voltage v, all of the LEDs D1, D2, . . . , Dn−1 are illuminated.

Figure 5:
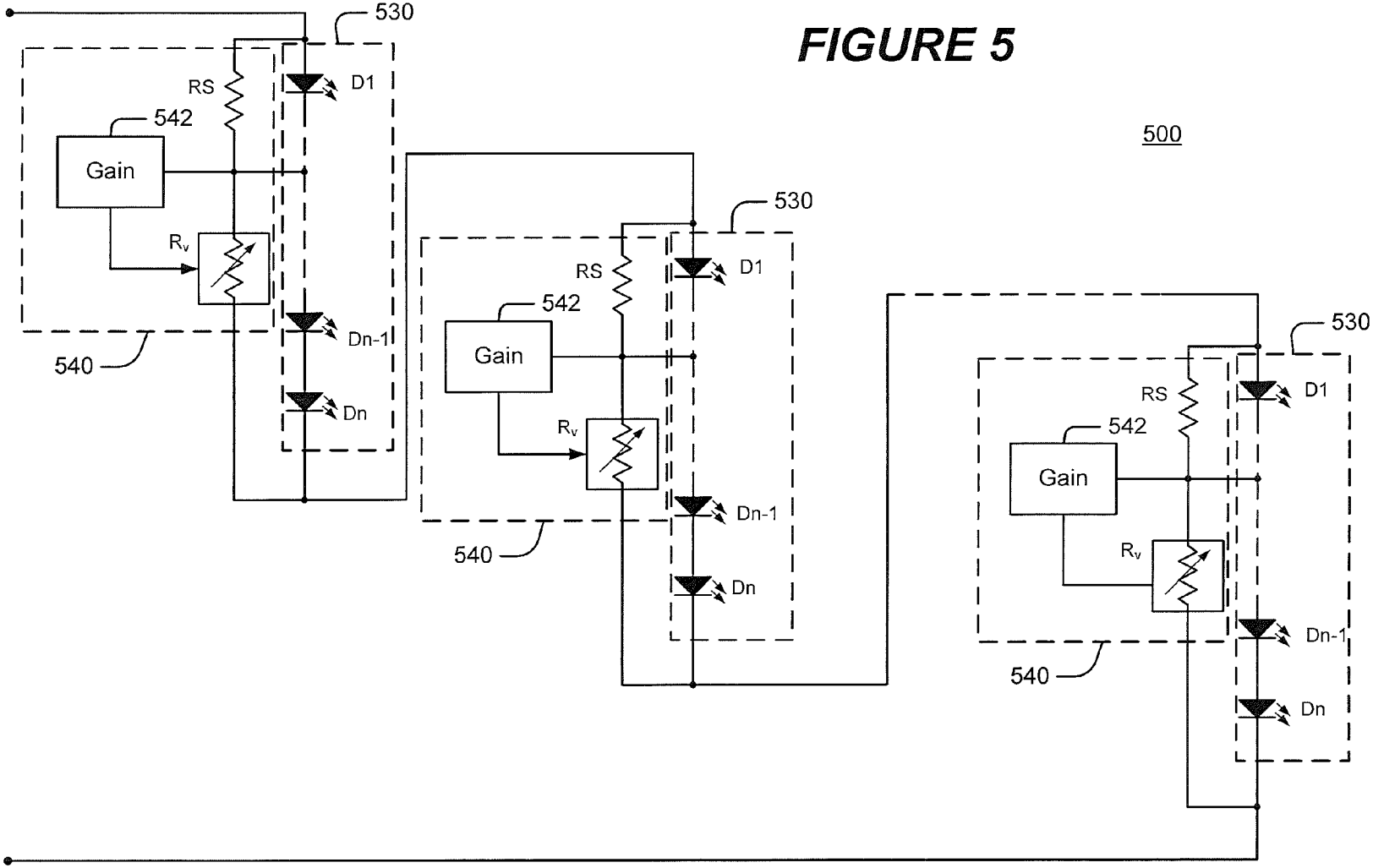
FIG. 5 illustrates a lighting apparatus according to further embodiments.

Similar functionality may be provided using current control elements with opposite polarity operations. FIG. 5 illustrates a lighting apparatus 500 that includes a plurality of LED strings 530, each of which include a plurality of serially-connected LEDs D1, . . . , Dn−1, Dn. The lighting apparatus 500 further includes a plurality of bypass circuits 540 coupled across respective ones of the strings 530 of LEDs. As illustrated, each bypass circuit 540 includes a current sense resistor RS configured to carry a bypass current $i_B$, coupled in series with a variable resistance $R_v$. Responsive to a voltage at a terminal of the current sense resistor RS, a gain circuit 542 controls the variable resistance $R_v$. An internal node of the associated string 530 is coupled to the current feedback input of the gain circuit 542, and the gain circuit 542 is configured to attenuate or block the bypass current $i_B$ responsive thereto.

Figure 6:
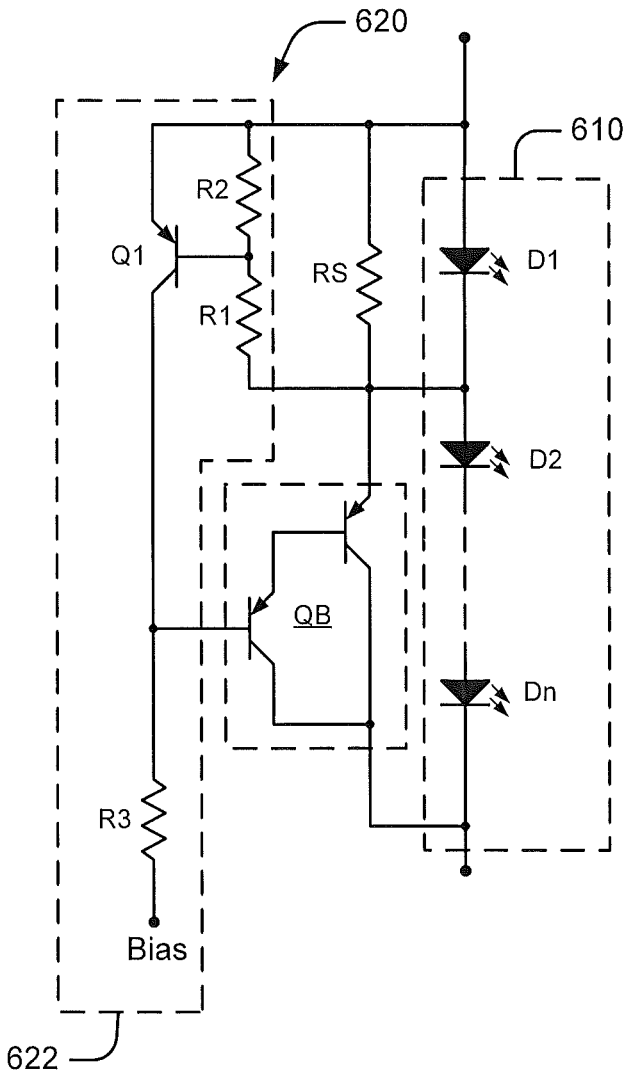
FIG. 6 illustrates a bypass circuit for the apparatus of FIG. 5 according to some embodiments.

FIG. 6 illustrates an exemplary implementation of a bypass circuit 620 that may be used in the arrangement of FIG. 2 according to some embodiments. The bypass circuit 620 includes a current sense resistor RS coupled in series with a Darlington PNP transistor QB across a string 610 of LEDs D1, D2, . . . , Dn. The bypass circuit 620 further includes a gain circuit 622, which controls the transistor QB. The gain circuit 622 includes resistors R1, R2, R3 and a PNP transistor Q1. The bias for the resistor R3 may be provided by another stage. The bypass circuit 620 operates in an inverted manner with respect to the bypass circuit 320 of FIG. 3, e.g., the bypass current is blocked when current begins to flow from the current sense resistor RS into the LEDs D2, . . . , Dn.

Figure 7:
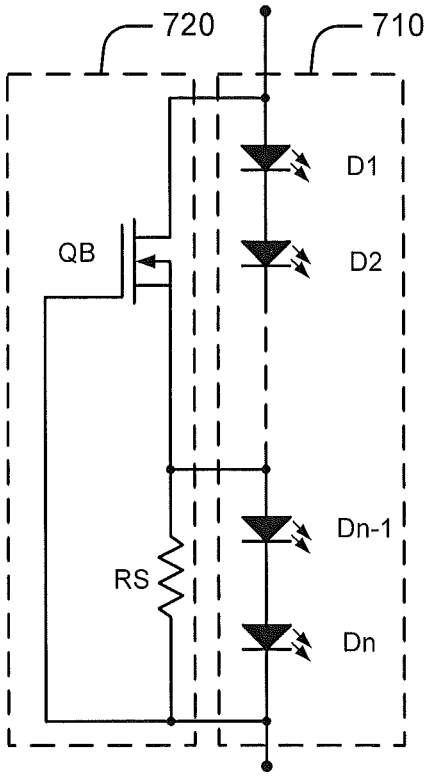
FIG. 7 illustrates a bypass circuit for a lighting apparatus according to further embodiments.

FIG. 7 illustrates another implementation for a bypass stage using and FET rather than a bipolar transistor. A bypass circuit 720 for a string 710 of LEDs D1, D2, . . . , Dn−1, Dn includes a depletion-mode MOSFET QB coupled in series with a current sense resistor RS. The bypass circuit 720 operates in a manner similar to the circuit of FIG. 3. In these embodiments, gain from the current sense resistor RS voltage is inherently provided by the structure of the depletion-mode MOSFET QB, rather than by additional circuit components. Such an arrangement may be particularly advantageous for an integrated circuit or module that combines such bypass circuitry along with LEDs on a common microelectronic substrate.

Figure 8:
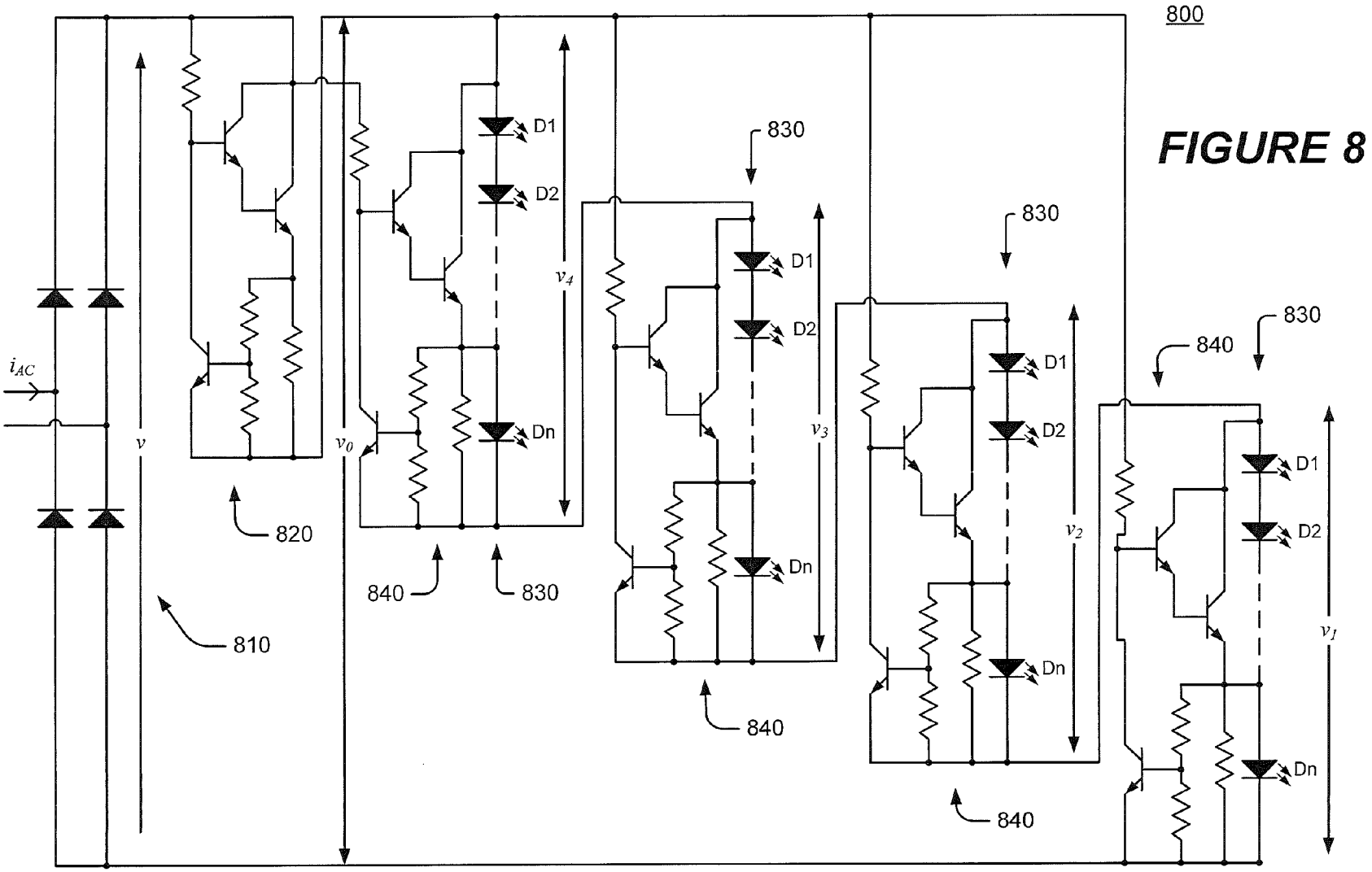
FIG. 8 illustrates a lighting apparatus according to further embodiments.

FIG. 8 illustrates a lighting apparatus 800 according to further embodiments. The apparatus 800 includes a diode bridge full wave rectifier circuit 810 configured to be coupled to an AC source and to produce a full-wave rectified AC voltage v therefrom. A first current source circuit 820 has an input coupled to the rectifier circuit 810 and an output coupled to a series of LED stages, each including a string 830 of diodes D1, D2, . . . , Dn and a bypass circuit 840 having a similar configuration to the current source circuit 820, except that current feedback nodes of the bypass circuits 840 are coupled to internal nodes of the LED strings 830.

Figure 9:
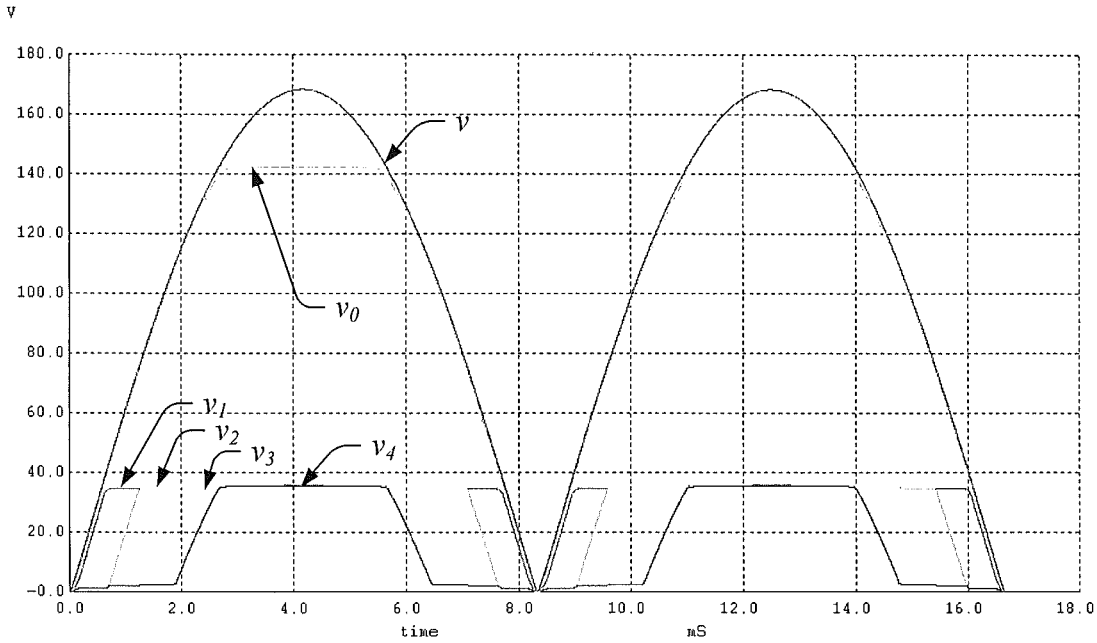
FIGS. 9 and 10 illustrate performance characteristics of a lighting apparatus arranged according to FIG. 8.
Figure 10:
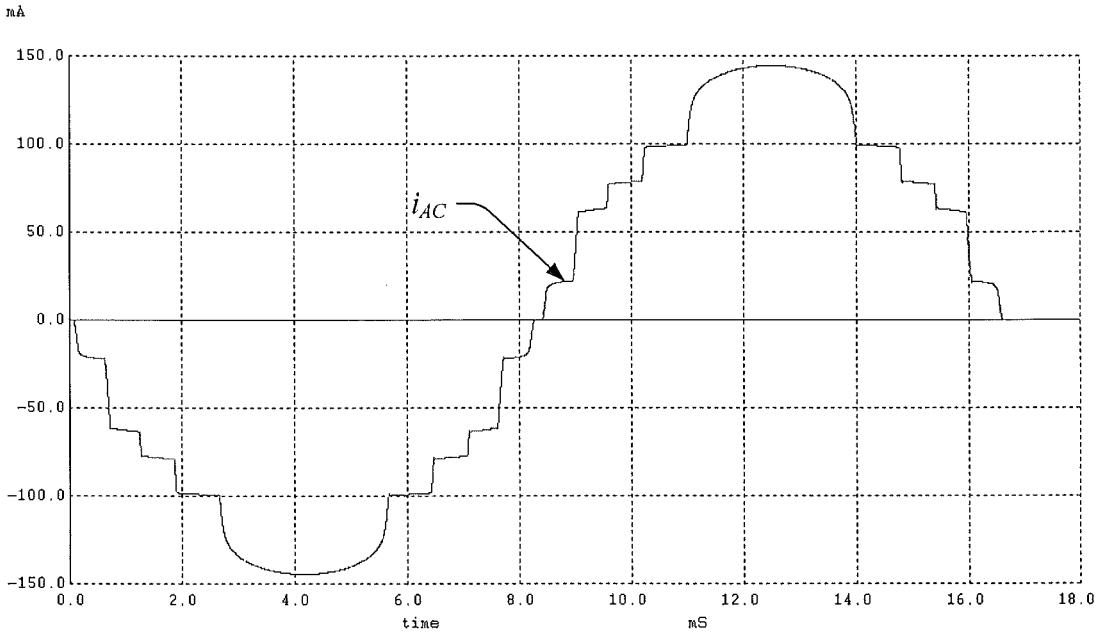

The apparatus 800 is configured to sequentially activate/deactivate the LED strings 830 as the full-wave rectified voltage v increases and decreases. FIG. 9 illustrates the rectified voltage v output by the rectifier circuit 810, the output voltage $v_0$ output from the current source circuit 820 and respective voltages $v_1$, $v_2$, $v_3$, $v_4$ across the respective LED strings 830, while FIG. 10 illustrates the input current $i_{AC}$ to the rectifier circuit 810. As can be seen, the input current $i_{AC}$ waveform conforms relatively closely to the input AC voltage waveform, thus enabling the apparatus to provide a power factor relatively near unity.

It will be appreciated that embodiments of the inventive subject matter may be physically arranged in any of a number of different ways. For example, LEDs and control circuitry along the lines discussed above with reference to FIGS. 1-8 may be integrated in a single circuit substrate, circuit board, module or the like. In other embodiments, control circuitry and LEDs may be implemented in separate packages or modules that are configured to be interconnected to provide a lighting apparatus. Portions of the control circuit may also be integrated in separate packages or modules that may be interconnected.

Figure 11:
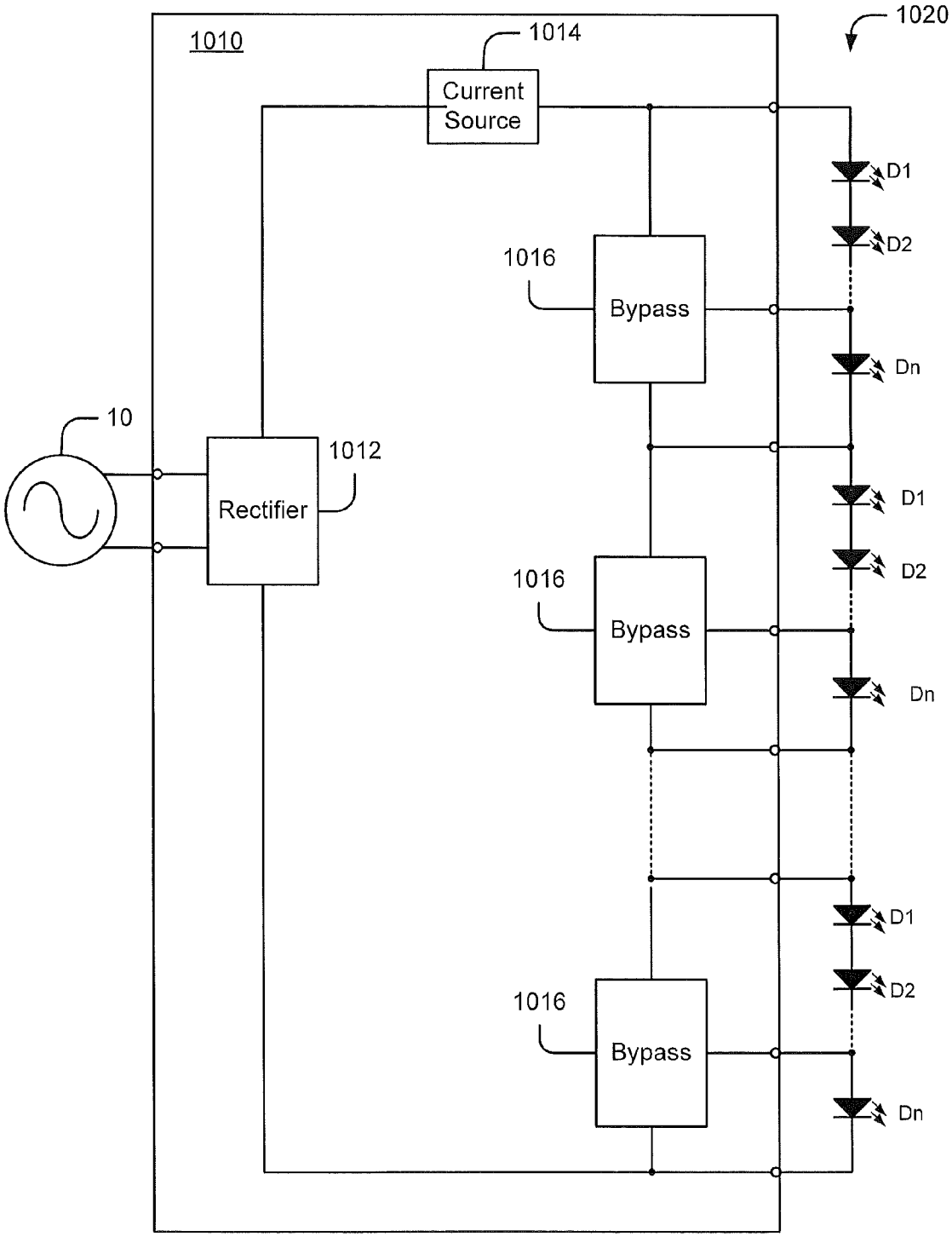
FIG. 11 illustrates a controller for a lighting apparatus according to further embodiments.

For example, FIG. 11 illustrates a lighting apparatus utilizing a controller device 1010 that is configured to be coupled to nodes of a string 1020 of LEDs via a set of external terminals. It will be appreciated the string 1020 may comprise discrete devices and/or an integrated circuit or module comprising the string 1020 with external terminals for connection thereto. The controller device 1010 includes a plurality of bypass circuits 1016, which may be configured along the lines discussed above. The controller device 1010 may further include a rectifier circuit 1012 and a current source circuit 1014. The rectifier circuit 1010 may be configured to be coupled to an AC power source 10 via additional terminals of the controller device 1000. It will be appreciated that, in other embodiments, the rectifier circuit 1012 and/or the current source circuit 1014 may be packaged separately from the bypass circuits 1016 and configured to be interconnected therewith.

In the drawings and specification, there have been disclosed typical embodiments of the inventive subject matter and, although specific terms are employed, they are used in a generic and descriptive sense only and not for purposes of limitation, the scope of the inventive subject matter being set forth in the following claims.

What is claimed is:

1. A lighting apparatus comprising:

a plurality of light emitting diode (LED) sets coupled in series; and a bypass circuit coupled in parallel with one of the LED sets and configured to sense and control a bypass current when the one of the LED sets is in a first conduction state and to attenuate the bypass current responsive to a transition of the one of the LED sets to a second conduction state.

2. The lighting apparatus of claim 1, wherein the first conduction state is less conducting than the second conduction state.

3. The lighting apparatus of claim 1, wherein the bypass circuit comprises a plurality of bypass circuits, respective ones of which are coupled in parallel with respective ones of the LED sets.

4. The lighting apparatus of claim 3, wherein the LED sets are disjoint.

5. The lighting apparatus of claim 1, wherein the bypass circuit comprises:

a current sensor configured to sense the bypass current; and a current control circuit coupled to the current sensor and configured to control the bypass current responsive to the current sensor.

6. The lighting apparatus of claim 5, wherein the at least one of the LED sets comprises a string of LEDs coupled in series and wherein the current sensor is coupled to an internal node of the string and configured to conduct a current to or from the internal node.

7. The lighting apparatus of claim 6, wherein the current control circuit comprises a transistor having a first terminal coupled to a first terminal node of the string and wherein the current sensor comprises a resistor having a first terminal coupled to a second terminal node of the string and a second terminal coupled to a second terminal of the transistor and to an internal node of the string.

8. The lighting apparatus of claim 7, wherein the second terminal of the resistor is coupled to the internal node of the string.

9. The lighting apparatus of claim 7, wherein the current control circuit further comprises a gain circuit configured to control the transistor responsive to a voltage at the first terminal of the resistor.

10. The lighting apparatus of claim 7, wherein the transistor comprises a bipolar junction transistor or a field-effect transistor.

11. The lighting apparatus of claim 10, further comprising a rectifier circuit having an input configured to be coupled to an AC power source and an output coupled to the current control circuit and the plurality of LED sets.

12. The lighting apparatus of claim 1, wherein the bypass circuit is configured to maintain a substantially constant bypass current when the at least one of the LED sets is in the first conduction state.

13. The lighting apparatus of claim 1, further comprising a current control circuit coupled in series with the plurality of LED sets.

14. A controller for a lighting apparatus, the controller comprising:

a plurality of bypass circuits configured to be coupled in parallel with respective ones of a plurality of LED sets coupled in series, each bypass circuit configured to sense and control a bypass current when the LED set coupled in parallel therewith is in a first conduction state and to attenuate the bypass current responsive to a transition of the LED set coupled in parallel therewith to a second conduction state.

15. The controller of claim 14, wherein the first conduction state is less conducting than the second conduction state.

16. The lighting apparatus of claim 14, wherein the LED sets are disjoint.

17. The controller of claim 14, wherein each bypass circuit comprises:

a current sensor configured to sense the bypass current; and a current control circuit coupled to the current sensor and configured to control the bypass current responsive to the current sensor.

18. The controller of claim 17, wherein the LED set coupled in parallel therewith comprises a string of LEDs coupled in series and wherein the current sensor is coupled to an internal node of the string and configured to conduct a current to or from the internal node.

19. The controller of claim 18, wherein the current control circuit comprises a transistor having a first terminal coupled to a first terminal node of the string and wherein the current sensor comprises a resistor having a first terminal coupled to a second terminal node of the string and a second terminal coupled to a second terminal of the transistor and to the internal node of the string.

20. The controller of claim 19, wherein the current control circuit further comprises a gain circuit configured to control the transistor responsive to a voltage at the second terminal of the resistor.

21. The controller of claim 19, wherein the transistor comprises a bipolar junction transistor or a field-effect transistor.

22. The controller of claim 14, wherein each bypass circuit is configured to maintain a substantially constant bypass current when the LED set coupled in parallel therewith is in the first conduction state.

23. A lighting apparatus comprising:

a plurality of strings of LEDs coupled in series; and respective bypass circuits coupled in parallel with respective ones of the strings, each bypass circuit comprising:

a transistor having a first terminal coupled to first terminal node of one of the strings; and a resistor having a first terminal coupled to a second terminal node of the one of the strings and a second terminal coupled to a second terminal of the transistor and to an internal node of the one of the strings separated from each of the first and second terminal nodes by at least one LED, the resistor and transistor configured to conduct a bypass current between the first and second terminal nodes of the one of strings.

24. The lighting apparatus of claim 23, wherein the bypass circuits are coupled in series.

25. The lighting apparatus of claim 23, wherein each bypass circuit further comprises a gain circuit configured to control the transistor responsive to a voltage at the second terminal of the resistor.

26. The lighting apparatus of claim 23, wherein the transistor comprises a bipolar transistor or a field effect transistor.

27. A lighting apparatus comprising:

a plurality of strings of LEDs coupled in series; and a bypass circuit having first and second terminals coupled to first and second terminal nodes of one of the strings and a third terminal coupled to an internal node of the one of the strings separated from each of the first and second terminal nodes by at least one LED, the bypass circuit configured to control a bypass current between the first and second terminal nodes responsive to a current to or from the internal node.

28. The lighting apparatus of claim 27, wherein the bypass circuit comprises a current sense input coupled to the internal node of the one of the strings.

29. The lighting apparatus of claim 28, wherein the bypass circuit comprises a current sense resistor configured to conduct the bypass current and coupled to the internal node of the one of the strings.

30. The lighting apparatus of claim 29, wherein the bypass circuit comprises a transistor coupled between the current sense resistor and one of the first and second terminal nodes of the one of the strings.

31. The lighting apparatus of claim 30, wherein the bypass circuit comprises a gain circuit coupled to the current sense resistor and configured to control the transistor.

32. The lighting apparatus of claim 27, wherein the bypass circuit is configured to block the bypass current responsive to a current to or from the internal node of the one of the strings.

33. The lighting apparatus of claim 27, wherein the bypass circuit is configured to source or receive the current to or from the internal node responsive to a biasing of a subset of the LEDs of the one of the strings.

34. The lighting apparatus of claim 33, wherein the bypass circuit is configured to maintain the bypass current at a substantially constant level when the subset of the LEDs of the one of the strings is substantially non-conducting.

35. The lighting apparatus of claim 27, wherein the bypass circuit comprises a plurality of bypass circuits, respective ones of which coupled in parallel with respective ones of the strings.

* * * * *